US005410281A

United States Patent [19]

Blum

[11] Patent Number: 5,410,281

[45] Date of Patent: Apr. 25, 1995

[54] MICROWAVE HIGH POWER COMBINER/DIVIDER

[75] Inventor: Richard J. Blum, Buffalo, N.Y.

[73] Assignee: Sierra Technologies, Inc., Buffalo, N.Y.

[21] Appl. No.: 28,288

[22] Filed: Mar. 9, 1993

[51] Int. Cl.[6] ..... H01P 5/12

[52] U.S. Cl. ..... 333/127; 333/128

[58] Field of Search ..... 333/125, 127, 128

[56] References Cited

U.S. PATENT DOCUMENTS

| | | | |
|---|---|---|---|
| 2,963,664 | 12/1960 | Yeagley | 333/127 |
| 3,091,743 | 5/1963 | Wilkinson | 333/127 |
| 3,529,265 | 9/1970 | Podell | 333/127 |
| 3,904,990 | 9/1975 | La Rosa | 333/125 X |
| 4,163,955 | 8/1979 | Iden et al. | 333/127 |
| 4,365,215 | 12/1982 | Landry | 333/127 |
| 4,371,845 | 2/1983 | Pitzalis, Jr. | 330/277 |
| 4,463,326 | 7/1984 | Hom | 333/128 |
| 4,721,929 | 1/1988 | Schnetzer | 333/127 |

*Primary Examiner*—Paul Gensler
*Attorney, Agent, or Firm*—Brooks & Kushman

[57] ABSTRACT

Provided is a microwave apparatus for dividing input power to plural outputs or, alternatively, combining power from plural inputs to a single output. The apparatus includes a plurality of isolation resistors, removed from the body of the apparatus by means of respective coaxial transmission line segments. This configuration combines the properties of isolation between the various input/output ports, and effective cooling of the isolation resistors to facilitate high power conditions and a bandwidth of at least 1 octave.

6 Claims, 2 Drawing Sheets

MICROWAVE HIGH POWER COMBINER/DIVIDER

TECHNICAL FIELD

This invention relates to microwave apparatus for dividing input power to plural outputs or alternately, combining power from plural inputs to a single output.

BACKGROUND OF THE INVENTION

Microwave combiner/divider devices are well known to those skilled in the art. These devices consist of a common port and the plurality of input/output ports. If operated as a divider, an input signal is fed to the common port and the input power is divided amongst the plurality of input/output ports which serve as outputs. In the combiner mode, a plurality of inputs are fed to the input/output ports and a single output which combines the power of the various input is present on the common port.

An example of one such device is described in U.S. Pat. No. 2,963,664, issued to Yeagley. This patent discloses a high frequency power dividing apparatus for continuous stepless division of radio frequency power without appreciable phase shift. The device comprises a pair of branch circuits connected in parallel at their input ends to the source, which may be a radio frequency power source. Each of the branch circuits include a first quarter wavelength transformer which may be a linear quarter wavelength coaxial or other type of transmission line, connected directly in series with a second quarter wavelength transformer, such as a second quarter wavelength transmission line having a variable characteristic impedance. The inner conductors of the first transmission line are connected together to the source at one end and at the other end each is connected to one conductor of the second line. The outer conductors of the first lines and the outer conductors of the second lines are connected together, and connected to the other terminal of the source which may be at ground potential. The output of each of the second lines is connected to a load which is preferably purely resistant and has a resistance equal to the impedance of the source, to the characteristic impedance of the first transmission line and also to the maximum characteristic impedance of the second transmission line. By varying the characteristic impedances of these second transmission lines differentially, the power supplied to the load may be given any desired ratio and the impedances of the second lines may be adjusted so that the impedance presented to the source always remains constant.

Similarly, U.S. Pat. No. 4,371,845, issued to Pitzalis, Jr., discloses a modular microwave power divider amplifier combiner. The apparatus includes a power input/output port and a microwave power energy radial divider/combiner section which includes plural microwave energy transmission lines symmetrically radiating from the common port to the outer edge of the divider/combiner section. Each microstrip transmission line includes a microstrip conductor extending from the common input/output port to the outer edge of the divider/combiner section. The apparatus also includes means for transmitting microwave energy between the input/output port and the divider/combiner section.

It should be noted that neither the Yeagley patent nor the Pitzalis, Jr. patent provide for isolation resistors to isolate signals from one input/output port to another. If one of the sources/sinks were to fail, this could greatly disturb the power distribution for each of the functioning input/output ports.

A device which provides for isolation of the input/output ports is described in U.S. Pat. No. 3,091,743, issued to Wilkinson. This patent discloses the power divider that is capable of distributing input radio frequency energy equally between a selected number of output loads. The power divider consists of a coaxial transmission line structure having hollow cylindrical inner and outer conductors, the inner conductor of which is split into a plurality of equal length circumferentially spaced splines. Preferably, the number of splines is equal to the desired number of output channels. All of the splines are shorted together at the input to accommodate a common input terminal, and at the output end, each of the splines is connected to a suitable terminating resistor. The terminating resistors are of identical value, one terminal of each of which is connected to an electrically neutral or floating common junction.

In operation, a signal applied to the input terminal divides equally among the plurality of splines, each of which with the outer conductor, functions as a transmission line. The terminating resistors in conjunction with the splines prevent interaction of the output signals. The input impedance of the divider is matched to the characteristic impedance of each of the output transmission lines when the conditions for isolation are satisfied, and consequently, does not introduce discontinuities in the system in which it is used.

Similarly, U.S. Pat. No. 3,529,265, issued to Podell, discloses a radio frequency power divider, which provides isolation. An input port of characteristic impedance $Z_1$ is connected across a number of transmission lines (N) arranged such that a serial combination of the input ends of the transmission lines is connected between the two terminals which form the input port. Preferably, N is equal to the power division factor. Thus, if the power divider is to be a three-way divider, then there are three transmission lines. The transmission lines are each one quarter wavelength long at the center frequency of the operating bandwidth and the one conductor of each of the transmission lines is grounded at the end and removed from the input port. The characteristic impedance of each of these transmission lines is selected according to the desired standing wave ratio versus frequency characteristic.

In accordance with the disclosed invention, each one of the transmission lines has connected to it at the end removed from the input port a second quarter wavelength section of transmission line having the same characteristic impedance. One conductor of each of the second group of transmission lines is connected at one end to the non-ground conductor of the corresponding one of the first group of transmission lines. The other end of the conductor of the second transmission line is connected through a terminating impedance to a floating junction. The value of each of the terminating impedances will depend upon the load impedances. The characteristic impedances of the transmission line sections are selected to provide both matching of the second group of transmission lines and isolation of the ports.

U.S. Pat. No. 4,365,215, issued to Landry, also discloses a power divider which provides isolation between input/output ports. The power divider operates over a predetermined frequency band and includes an inner conductor system including a common leg and N-branch legs extending from a common junction with the common leg. The divider also includes an N-terminal resistance element for dissipating odd-mode power and for isolating said N-branch ports from each other with each of the end terminals connected to an associated branch leg at a distance from the common junction of approximately $\frac{1}{4}$ wavelength at a frequency in the band. The divider also includes an outer conductor enclosing the inner conductor system and a thermally conducting dielectric heat sink coupled between the resistance element and the outer conductor for conducting heat away from the resistance element. The heat sink between the resistance element and the outer conductor is configured to form a lower dielectric constant than the heat sink between the resistance element and the outer conductor, to provide a lower capacitance between the resistance element and the outer conductor than would be provided in the absence of the lower dielectric constant region. Thus, problems of the prior art, such as limited power handling capabilities, are overcome by placing the isolation resistors inside the outer conductor of the coaxial transmission line on an electrically insulating resistor contact portion of a low capacitance, high thermal conductivity heat sink.

In addition, U.S. Pat. No. 4,721,929, issued to Schnetzer, discloses a multi-stage power divider with isolation. A plurality of passive circuit elements, such as resistors, are arranged to defined a plurality of radial frequency pathways between a power input and a plurality of power outputs, and to divide incoming radio frequency power among the plurality of outputs in a preselected ratio. The passive circuit elements are connected to define a plurality of power-dividing junctions that are located in sequence in at least one radio frequency pathway between the power input and the power output to further divide the radio frequency power and at least one radio frequency pathway. The passive circuit elements also connect the radio frequency power further divided from that one pathway with the radio frequency power in another pathway at a power-combining junction in another pathway, and to provide electrical resistance between the junctions for the further divider power and the adjacent radio frequency pathways. Thus, power division is dependent only upon the line impedances and more practically realizable line impedances are maintained then in conventional broad band dividers, allowing for greater power division ratios than can be implemented in a single resistant power divider.

The systems disclosed in the Wilkinson, Podell, Landry and Schnetzer patents solve the problems of isolation using a series of resistor switches that dissipate any energy created by a failed component. However, each of these systems has a serious resistor cooling problem. Specifically, there is no effective way to remotely locate these load resistors for effective cooling.

U.S. Pat. No. 4,163,955, issued to Iden et al., discloses a cylindrical mode power divider/combiner with isolation which addresses the problem of resistor cooling. The power divider/combiner includes an outer conductor having a longitudinal axis and an impedance transformer means disposed coaxial of the axis and within the outer conductor. Also included is an input/output coaxial transmission line coupled to the transformer means and the outer conductor. First N-discrete, spaced transmission lines supported by a first dielectric cylinder disposed coaxial with the axis and within the outer conductor are also included, each of the first transmission lines being coupled to the transformer means, wherein N is an integer greater than 1. Also included are second N-discrete, spaced transmission lines disposed coaxial of and transverse to the axis remote from the transformer means, each of the second transmission lines being coupled to a different one of the first transmission lines and terminating in a common metallic disk coaxial of and adjacent the axis. The device also includes N-output/input ports each coupled to a different one of the first transmission lines adjacent the transformer means and N-load ports each coupled to a different one of the first transmission lines adjacent the second transmission lines. With the isolating means coupled to ground, this power divider/combiner is advantageous over the Wilkinson device, which includes isolating loads that are "floating." By coupling the loads to ground, the power limitations associated with heat sinking of the resistors in the Wilkinson device are avoided.

U.S. Pat. No. 4,463,326, issued to Hom, also discloses a planar N-way combiner/divider which addresses both isolation and power dissipation. The apparatus, if used as a power combiner, includes a common port at which the combined energy is available. From this common port, a ring-type impedance matching arrangement is included connected to a division point with N microstrip traces radiating therefrom, where N is the number of branch ports provided. From the common point, after impedance transformation, the layout of the microstrip traces is such that alternate branch ports are fed through a path $\frac{1}{2}$ wavelength longer than that of the remaining branch port connections. The microstrips circuit traces are so arranged that the desired circuit paths between the division point associated with the common port and each of the branch ports compensates for the phase differentials at the branch ports by virtue of corresponding circuit path length differentials. As disclosed by Hom, isolation resistors are grounded by means of a conventional microstrip quarter wave stub on one end and points along the circuit traces leading from alternate branch ports where the path lengths to the points of resistor connection produce a ORF potential and therefore zero current in the resistors, corresponding to a completely balanced operation. Thus, the prior art limitation respecting power dissipation on the isolation resistors is greatly relieved through the use of the circuit of the present invention.

The patents to Iden and to Hom disclose a power divider/combiner combination which may yield practical cooling of the isolation resistors. However, each of these configurations suffer from a narrow bandwidth which limit the usefulness of the devices in wideband applications.

SUMMARY OF THE INVENTION

It is an object of the present invention to overcome the problems of the prior art high power combiner/divider devices by providing an apparatus which combines the properties of isolation between the various input/output ports, remote location of the isolation resistors to facilitate effective cooling of the apparatus to handle high power conditions, and a relatively wide bandwidth of at least one octave.

A specific object of the present invention is to improve the standard Wilkinson power combiner/divider by providing means for locating the isolation resistors to facilitate effective cooling.

In carrying out the above object, the power divider/-combiner of the present invention comprises a primary port and a first plurality of $\frac{1}{4}$ wavelength transmission line segments having equal characteristic impedances and each having primary and secondary conductors with respective first and second ends.

There is further provided first coupling means for coupling the respective primary conductor first ends of the plurality of transmission line segments to the primary port. A plurality of input/output ports are also provided. These input/output ports are in electrical contact with the respective primary conductor second ends of the plurality of transmission line segments. In addition, a second plurality of transmission line segments are provided. These second transmission line segments each have equal characteristic impedances and each have primary and secondary conductors with respective first and second ends. The primary conductor second ends of the plurality of transmission line segments are in electrical contact with the primary conductor first ends of the second plurality of transmission line segments. A junction is also provided as well as second coupling means for coupling the respective secondary conductor first ends of the second plurality of transmission line segments to the junction. A plurality of resistors are provided which have a resistance equal to the characteristic impedance of the second plurality of transmission line segments. Each of the resistors is coupled across respective primary and secondary conductor second ends of the second plurality of transmission line segments.

A more specific object of the present invention is to provide a microwave power divider/combiner comprising a primary port and a first plurality of $\frac{1}{4}$ wavelength transmission line segments, each having equal characteristic impedances and each having primary and secondary conductors with respective first and second ends. A multi-stage quarter wave impedance transformer is further provided. This impedance transformer electrically couples the respective primary conductor first ends of the first plurality of transmission line segments to the primary port. Also, a plurality of input-/output ports is provided in electrical contact with the respective primary conductor second ends of the first plurality of transmission line segments.

Moreover, a second plurality of transmission line segments is provided. Each of these second plurality of transmission line segments have equal characteristic impedances and have primary and secondary conductors with respective first and second ends. The primary conductor second ends of the first plurality of transmission line segments are in electrical contact with the primary conductor first ends of the second plurality of transmission line segments.

In addition, a junction is provided as well as first coupling means for coupling the respective secondary conductor first ends of the second plurality of transmission line segments to the junction. Furthermore, a plurality of resistors is provided, each having a resistance equal to the characteristic impedance of the second plurality of transmission line segments. These resistors are coupled across respective primary and secondary conductor second ends of the second plurality of transmission line segments.

A supplemental transmission line segment is also provided which is approximately $\frac{1}{4}$ wavelength long. This supplemental transmission line segment has primary and secondary conductors with respective first and second ends. Second coupling means are further provided for coupling the supplemental transmission line primary conductor first end to the junction.

Finally, shunting means are provided for shorting the respective primary and secondary conductor second ends.

A further object of the present invention is to provide a microwave power divider/combiner comprising a conductive ground plane having a $\frac{1}{4}$ wavelength long well formed therein. A primary port is also provided having primary and secondary conductors where, the primary port second conductor is in electrical contact with the ground plane.

Moreover, a primary microstrip dielectric layer is deposited on the conductive ground plane and a multi-stage quarter wave microstrip transformer is deposited on the primary microstrip dielectric layer. This microstrip transformer has a first end in electrical contact with the primary conductor and also has a second end.

Additionally, a plurality of secondary microstrip dielectric layers are deposited on the ground plane and a plurality of secondary conductive strips are deposited on the plurality of secondary microstrip dielectrics. The secondary conductive strip first ends are in electrical contact with the primary conductive strip second end. These secondary conductive strips and corresponding microstrip dielectrics form a plurality of corresponding transmission line segments approximately $\frac{1}{4}$ wavelength long with equal characteristic impedances.

Similarly, a plurality of input/output ports having respective primary and secondary conductors are provided. The input/output port primary conductors extend through a corresponding aperture in the ground plane and the respective second microstrip dielectrics. The input/output port primary conductors are in electrical contact with the corresponding second conductive strip second ends. The input/output secondary conductors are in electrical contact with the ground plane.

A plurality of coaxial transmission line segments are further provided. These coaxial line segments are disposed above the ground plane well. The well has a first end at second conductive strip second ends. The coaxial lines have equal characteristic impedances and have primary and secondary conductors with respective first and second ends. The coaxial line primary conductor first ends are in electrical contact with the corresponding second conductive strip second ends. The coaxial line secondary conductor first ends are shorted together and isolated from the well first end. The coaxial line secondary conductor second ends are in electrical contact with the ground plane and the well second end.

Finally, a plurality of resistors having resistances equal to the characteristic impedance of the coaxial lines are provided. Each of the resistors are coupled across respective primary and secondary conductor second ends of the coaxial lines.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
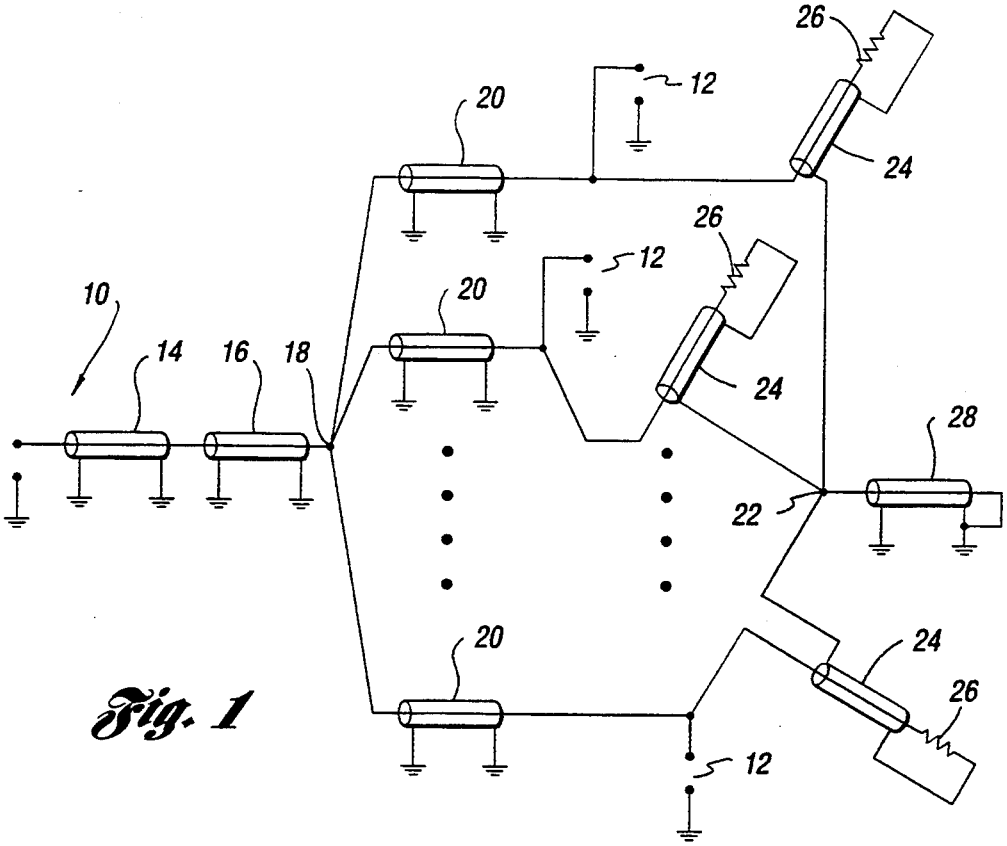
FIG. 1 is a schematic representation of one embodiment of the present invention.

The invention, in this preferred embodiment can serve as either a high power microwave combiner or high power microwave divider depending upon the choice of ports for the inputs and the outputs. Turning to FIG. 1, if common port 10 is chosen to be an input to the apparatus, input/output ports 12 will provide outputs of equal amplitude and phase. Similarly, a series of inputs can be fed into the input/output ports 12 to form a combined output at common port 10.

Turning again to FIG. 1, $\frac{1}{4}$ wavelength transmission line segments 14 and 16 couple common port 10 to junction 18. These transmission line segments can serve the purpose of transforming the impedance of the common port for the purposes of efficient power transfer. A plurality of $\frac{1}{4}$ wavelength transmission line segments 20 couple common port 18 to each of the input/output ports 12. The input/output ports 12 are, in turn, coupled to isolated common junction 22 by means of a plurality of transmission line segments 24 having arbitrary lengths, terminated by a like plurality of isolation resistors 26. Common junction 22 is isolated from ground via shorted $\frac{1}{4}$ wavelength transmission line segment 28.

In operation, when a signal is fed into the common port 10, it is divided by virtue of the symmetry into equal phase, equal amplitude signals at each of the input/output ports 12. Significantly, no power is dissipated by isolation resistors 26 when matched loads are connected to the input/output ports 12 since each of these ports are at the same potential. However, if a reflection occurs at one of the input/output ports, the reflected signal will split. Part of the reflected signal will travel directly to each of the remaining input/output terminals via transmission line segments 24 and load resistances 26. The remaining portion of the reflected signal will travel back to junction 18 splitting again amongst the remaining $\frac{1}{4}$ wavelength transmission line segments 20 and returning to the remaining input/output ports. The reflected wave arrives at the remaining input/output ports in two parts, and the path difference between the two paths of travel will be 180°. One with ordinary skill in the art will recognize when the value of the resistors and the characteristic impedance of the transmission lines are properly chosen, the two parts of the reflected wave will be equal in amplitude, causing complete cancellation of the reflected signal. See E. J. Wilkinson, "An N-Way Hybrid Power Divider", IRE TRANSACTIONS ON MICROWAVE THEORY AND TECHNIQUES, January 1960.

With reference still to FIG. 1, it is seen that transmission line segments 24 provide a way to remotely locate isolation resistors 26 while maintaining a resistive impedance between input/output ports 12 and common junction 22. The $\frac{1}{4}$ wavelength transmission line segment 28 is provided as a means for isolating common junction 22 from ground. The shorting of one end of this transmission line segment provides an effective open circuit-to-ground at the end connected to common junction 22 due to the transformation properties of a $\frac{1}{4}$ wavelength transmission line segment.

Significantly, applicants have found that in a condition where one or more of the input/output ports 12 is mismatched in the present invention, the isolation resistors 26 can be in a condition where they are dissipating considerable amounts of reflected power. The remote location of these resistors 26 is therefore desirable to allow for effective cooling. Those skilled in the art will recognize that the cooling of resistors 26 may lead to much higher power handling capacities for the overall apparatus.

Still referring to FIG. 1, it should be noted that in actual operation, the apparatus of the present invention will process signals over a wide range of frequencies rather than merely at a single frequency. Accordingly, applicants have found that the design of the present invention yields a bandwidth of approximately 1 octave. Given the nature of the present invention, this is a relatively wide bandwidth which is superior to other known designs. It should be noted, however, that because of the range of frequencies potentially being processed, it is impossible for certain transmission line segments to be an exact length in terms of the wavelength of processed frequencies. Thus, when it is stated herein and by those skilled in the art that a transmission line is $\frac{1}{4}$ wavelength long at a given frequency of operation, it is intended generally that the transmission line segment is approximately $\frac{1}{4}$ wavelength long over the band of permissible operating frequencies.

It should further be noted that the center frequency of operation for the apparatus of the present invention will be limited by the physical dimensions of the components which make up the apparatus. Components which make up point junctions in the apparatus must be small enough to react as a single point rather than as a distributed system at the frequency of operation. Thus, when higher frequencies are applied to a design whose junctions are of constant dimension, the performance of the design will degrade based upon the transformation of a point junction into a junction which is, in effect, distributed.

Figure 2:
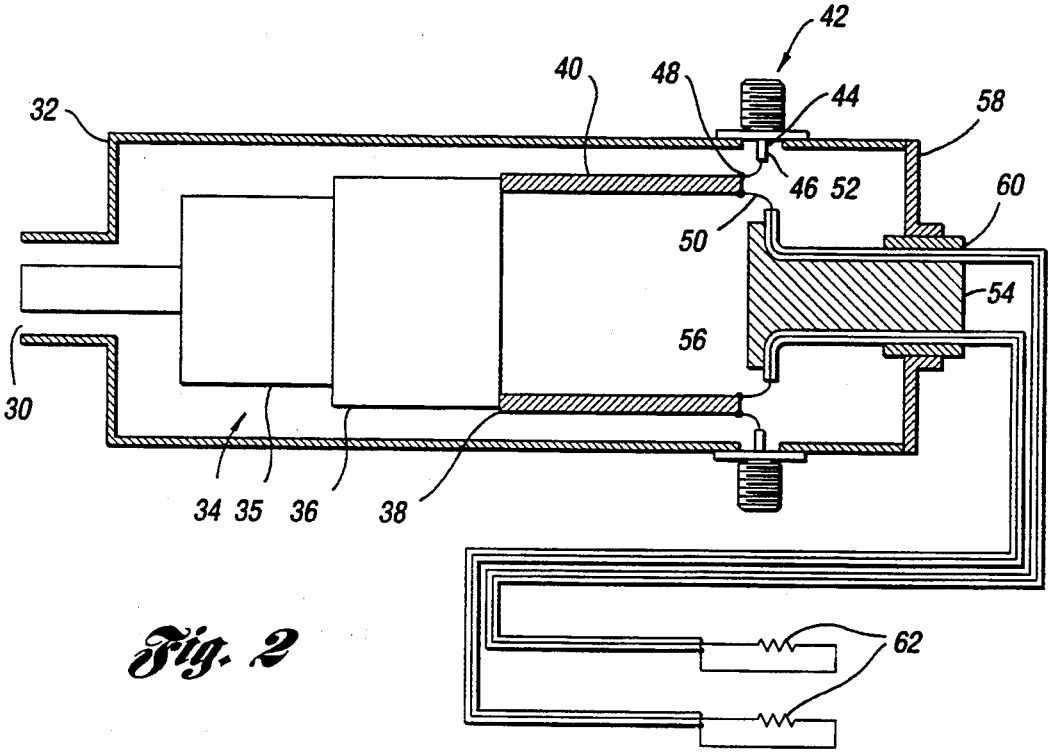
FIG. 2 is a cross-section of one embodiment of the present invention.

Referring now to FIG. 2, one embodiment of the present invention is shown. The apparatus is encased by cylindrical outer conductor 32 which begins with a $\frac{7}{8}''$ outer diameter at the common port 30 and steps to a $3\text{-}\frac{1}{8}''$ outer diameter for the remaining portion of the apparatus. Center conductor 34 is disposed within the outer conductor so as to provide a 50 ohm characteristic impedance at common port 30. The outer diameter of that center conductor is graduated so as to provide a first transmission line segment 35 created by the center and outer conductor with a characteristic impedance of 33.5 ohms and being approximately $\frac{1}{4}$ wavelength long at the frequency of operation. Outer conductor 32 couples the common port 30 having a 50 ohm impedance to a second transmission line segment 36 created between the center conductor 34 and the outer conductor 32 having a characteristic impedance of 14.4 ohms and being approximately $\frac{1}{4}$ wavelength long at the frequency of operation. By means of these quarter wavelength segments, the impedance of the common port is transformed.

With reference still to FIG. 2, it is seen that 14.4 ohm transmission line segment 36 terminates at junction 38 which connects transmission line segment 36 to twelve $\frac{1}{4}''$ diameter metal rods 40 spaced at 30° increments at the outer surface of center connector 34. These rods are disposed within outer conductor 32 such that each rod creates a 70 ohm transmission line segment between itself and the outer conductor approximately $\frac{1}{4}$ wavelength long at the frequency of operation.

Twelve TNC input connectors 42 are attached to the outer conductor 32 at 30° spacings in juxtaposition to each of the metal rods 40. The center conductor of each of the TNC connectors 46 is disposed within aperture 44 in outer conductor 32. Center conductor 46 of each of the input connectors 42 is further connected to the corresponding metal rod 40 at rod end 48. Each rod end 48 is in turn connected to the center conductor of one of twelve 0.141 inch outer diameter semi-rigid coax cables 52.

Still further, the outer conductor of each of the coax cables 52 is connected to metal spindle 54 at cap 56. Metal spindle 54 is electrically coupled to metal end cap 58 which is in turn electrically coupled to outer conductor 32 so as to provide a $\frac{1}{4}$ wavelength transmission line between the junctions of coax cables 52 and cap 56 and metal end cap 58. Each of the coax cables 52 extends through one of twelve apertures 60 in metal spindle 54 thereby allowing the 50 ohm isolation resistors 62 which terminate each coax cable 52 to be remotely cooled.

Figure 3:
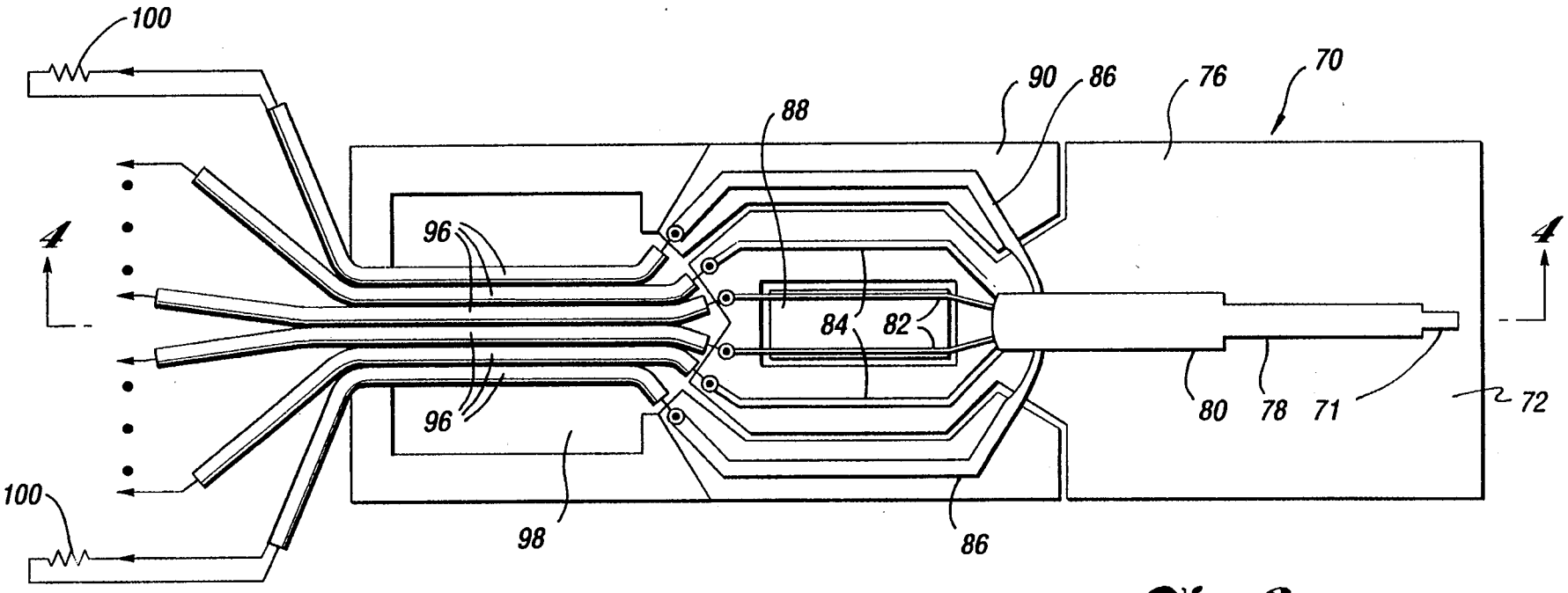
FIG. 3 is a top view of an alternative microstrip embodiment of the present invention.
Figure 4:
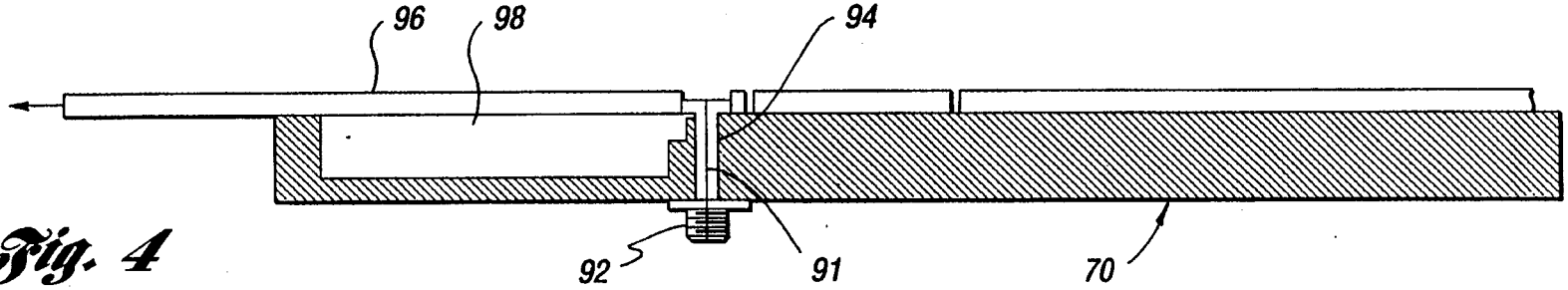
FIG. 4 is a side view of an alternate microstrip embodiment of the present invention.

With reference now to FIGS. 3 and 4, there is shown an alternative microstrip embodiment of the present invention which constitutes a one to six power divider. As shown in FIG. 3, metal ground plane 70 provides an electrical reference as well a mechanical support for the apparatus. 50 ohm input 72 is provided by conductive strip 71 disposed upon microstrip dielectric 76 which in turn is disposed upon metal ground plane 70. Conductor 71 widens into center conductor 78 which is approximately $\frac{1}{4}$ wavelength long at the frequency of operation. Conductor 78 in turn widens into conductor 80 which itself is $\frac{1}{4}$ wavelength long at the frequency of operation.

Still referring to FIG. 3, it is seen that conductor 80 branches into three pairs of conductors 82, 84, and 86. Conductors 82 are partially disposed upon a microstrip dielectric 88 whose dielectric constant is higher than that of microstrip dielectric 76. Conductor pair 84 is entirely disposed upon microstrip dielectric 76. Conductor pair 86 is partially disposed upon microstrip dielectric 90 whose dielectric constant is lower than the dielectric constant of microstrip dielectric 76. The dielectric constants of microstrip dielectric 88 and microstrip dielectric 90 are chosen such that the transmission line segments created between conductor pairs 82, 84 and 86 and metal ground plane 70 are all $\frac{1}{4}$ wavelength long at the frequency of operation.

In accordance with the invention, each of the conductors making up conductor pairs 82, 84 and 86 are terminated by connection to the center conductor 91 of one of six SMA connectors 92 by way of aperture 94 through metal ground plane 70 and each of the respective microstrip boards. Each of the conductors of conductor pairs 82, 84 and 86 are also terminated to the center conductor of one of six semi-rigid coax cables 96. The outer conductors of each of the six coax cables 96 are mechanically and electrically connected with one another, and disposed above well 98 in metal ground plane 70. The outer conductors of each of the coax cables 96 are further connected to ground plane 70 at the base of well 98 so as to form a transmission line segment between the outer conductors of the coaxial cables 96 and the ground plane 70 which is approximately $\frac{1}{4}$ wavelength long at the frequency of operation. Each of the six coaxial cables 96 is terminated by a 50 ohm isolation resistor 100.

While the best mode for carrying out the invention has been described in detail, those familiar with the art to which this invention relates will recognize various alternative designs and embodiments for practicing the invention as defined by the following claims.

What is claimed is:

1. A power divider/combiner, comprising:

a primary port;

a first plurality of transmission line segments, each of said line segments approximately $\frac{1}{4}$ wavelength long at a selected frequency of operation and having equal characteristic impedances, said line segments each having primary and secondary conductors with respective first and second ends;

a multi-stage quarter wave impedance transformer, said impedance transformer electrically coupling the respective primary conductor first ends of said first plurality of transmission line segments to said primary port;

a plurality of input/output ports in electrical contact with the respective primary conductor second ends of said first plurality of transmission line segments;

a second plurality of transmission line segments, each of said line segments having equal characteristic impedances and having primary and secondary conductors with respective first and second ends, said primary conductor second ends of said first plurality of transmission line segments in electrical contact with said primary conductor first ends of said second plurality of transmission line segments;

a junction;

first coupling means in electrical contact with said second plurality of transmission line segments and said junction for coupling the respective secondary conductor first ends of said second plurality of transmission line segments to said junction;

a plurality of resistors, each of said resistors having a resistance equal to the characteristic impedance of said second plurality of transmission line segments, each of said resistors coupled across respective primary and secondary conductor second ends of said second plurality of transmission line segments.

a supplemental transmission line segment, said line segment approximately $\frac{1}{4}$ wavelength long at said selected frequency of operation and having primary and secondary conductors with respective first and second ends;

second coupling means in electrical contact with said supplemental transmission line segment and said junction for coupling said supplemental transmission line segment primary conductor first end to said junction; and shunting means in electrical contact with said primary and secondary conductors of said supplemental transmission line segment for shorting the respective primary and secondary conductor second ends.

2. A power divider/combiner as in claim 1, wherein said supplemental transmission line segment comprises a conductive spindle disposed within a cylindrical outer conductor.

3. A power divider/combiner as in claim 2, wherein said first coupling means comprises the first end of said conductive spindle.

4. A power divider/combiner as in claim 1, wherein said first plurality of transmission line segments comprise a corresponding plurality of conductive rods disposed within a cylindrical outer conductor, said rods aligned parallel to the major axis of said cylindrical conductor about a concentric circle.

5. A power divider/combiner, comprising:

a primary port having primary and secondary conductors;

a cylindrical outer conductor having first and second ends, said outer conductor first end in electrical contact with said primary port secondary conductor;

a cylindrical inner conductor approximately $\frac{1}{2}$ wavelength long at a selected frequency of operation, said inner conductor disposed within said outer conductor and having a first end in electrical contact with said primary port primary conductor and a second end;

a plurality of conductive rods approximately $\frac{1}{4}$ wavelength long at said selected frequency of operation having respective first and second ends, said rods disposed within said cylindrical outer conductor, said rods aligned parallel to the major axis of said cylindrical outer conductor about a concentric circle, said conductive rods first ends in electrical contact with said inner conductor second end, each of said conductive rods forming a respective transmission line between itself and the outer conductor with an equal characteristic impedance;

a plurality of input/output ports, each of said ports having respective primary and secondary conductors, the primary conductors extending through a corresponding aperture in said outer conductor, said input/output port primary conductors in electrical contact with said respective conductive rod second ends, and said input/output port secondary conductors in electrical contact with said outer conductor;

a conductive end cap having an aperture, said end cap in electrical contact with and mechanically enclosing said outer conductor second end;

a conductive spindle approximately $\frac{1}{4}$ wavelength long at said selected frequency of operation, said spindle disposed within said outer conductor and having a first end and a second end, said spindle second end in electrical contact with and mechanically attached to said conductive end cap so as to provide a plurality of apertures between said end cap and said spindle;

a plurality of coaxial transmission line segments each of said coaxial lines extending through said respective spindle and end cap apertures, each of said coaxial lines having equal characteristic impedances and having primary and secondary conductors with respective first and second ends, said coaxial line primary conductor first ends in electrical contact with said respective conductive rod second ends, said coaxial line secondary conductor first ends in electrical contact with said conductive spindle first end; and a plurality of resistors, each of said resistors having a resistance equal to the characteristic impedance of said coaxial lines, each of said resistors coupled across respective primary and secondary conductor second ends of said coaxial lines.

6. A power divider/combiner, comprising:

a conductive ground plane having a well formed therein, said well being $\frac{1}{4}$ wavelength long at a selected frequency of operation having a first and a second end;

a primary port having a primary and secondary conductors, said primary port secondary conductor in electrical contact with said ground plane;

a primary microstrip dielectric layer deposited on said conductive ground plane;

a primary conductive strip forming a multistage quarter wave microstrip transformer with said ground plane, said primary conductive strip deposited on said primary microstrip dielectric layer, said primary conductive strip having a first end in electrical contact with said primary port primary conductor and a second end;

a plurality of secondary microstrip dielectric layers deposited on said ground plane;

a plurality of secondary conductive strips, each of said strips having first and second ends and deposited on said plurality of secondary microstrip dielectrics, said secondary conductive strip first ends in electrical contact with said primary conductive strip second end, said secondary conductive strips and said corresponding secondary microstrip dielectrics forming a plurality of corresponding transmission line segments approximately $\frac{1}{4}$ wavelength long at said selected frequency of operation with equal characteristic impedances;

a plurality of input/output ports having respective primary and secondary conductors, said input/output port primary conductors extending through a corresponding aperture in said ground plane and said respective second microstrip dielectrics, said input/output port primary conductors in electrical contact with said corresponding second conductive strip second ends, said input/output port secondary conductors in electrical contact with said ground plane;

a plurality of coaxial transmission line segments each of said segments approximately $\frac{1}{4}$ wavelength long at said selected frequency of operation and disposed above said ground plane well, said well having a first end at second conductive strip second ends and a second end, said coaxial lines having equal characteristic impedances and having primary and secondary conductors with respective first and second ends, said coaxial line primary conductor first ends in electrical contact with said corresponding second conductive strip second ends, said coaxial line secondary conductor first ends shorted together and isolated from said well first end, said coaxial line secondary conductors in electrical contact with said ground plane at said well second end;

a plurality of resistors, each of said resistors having a resistance equal to the characteristic impedance of said coaxial lines, each of said resistors coupled across respective primary and secondary conductor second ends of said coaxial lines.

* * * * *